US008479411B1

(12) United States Patent
Quinones

(10) Patent No.: US 8,479,411 B1
(45) Date of Patent: Jul. 9, 2013

(54) ADJUSTABLY VENTED SHOE AND ASSOCIATED METHOD

(76) Inventor: Victor Quinones, Yuma, AZ (US)

( * ) Notice: Subject to any disclaimer, the term of this patent is extended or adjusted under 35 U.S.C. 154(b) by 380 days.

(21) Appl. No.: 12/837,027

(22) Filed: Jul. 15, 2010

Related U.S. Application Data

(60) Provisional application No. 61/225,962, filed on Jul. 16, 2009.

(51) Int. Cl.
*A43B 7/10* (2006.01)
*A43B 7/08* (2006.01)

(52) U.S. Cl.
USPC ..... 36/3 A; 36/3 R

(58) Field of Classification Search
USPC ..... 36/3 R, 3 A, 3 B
See application file for complete search history.

(56) References Cited

U.S. PATENT DOCUMENTS 752,254 A * 2/1904 Patton ..... 36/3 A
1,202,827 A * 10/1916 Gerhold ..... 36/3 R
1,390,929 A * 9/1921 Saudino ..... 36/3 R
1,742,772 A * 1/1930 Langan et al. ..... 36/3 B
5,357,689 A * 10/1994 Awai ..... 36/3 A
5,551,172 A * 9/1996 Yu ..... 36/3 A
5,732,485 A * 3/1998 Laughlin et al. ..... 36/136
5,921,003 A * 7/1999 Kim ..... 36/3 B
5,924,221 A * 7/1999 Schuver et al. ..... 36/136
6,553,690 B2 4/2003 Di Girolamo
6,711,832 B2 * 3/2004 Chen ..... 36/3 R
7,146,750 B2 12/2006 Issler
7,178,266 B2 2/2007 Deem
2004/0006889 A1 * 1/2004 Chen ..... 36/3 R

* cited by examiner

*Primary Examiner* — Marie Patterson

(57) ABSTRACT

An adjustably vented shoe including a body adapted to cover an entire user foot therein. Such a body preferably has an outer surface provided with an opening formed therethrough. The shoe further includes a first plate statically interfitted within the opening, a mesh screen statically interfitted within the opening and abutted with the first plate respectively, and a second plate adjustably engaged with the first plate respectively. Notably, the first plate and the mesh screen remain stationary while the second plate is dynamically displaced between open and closed positions relative to the first plate and the mesh screen respectively. In this manner, the mesh screen is exposed to ambient air when the second plate is displaced to the open position such that air is permitted to freely ingress and egress the shoe via the mesh screen.

10 Claims, 7 Drawing Sheets

ADJUSTABLY VENTED SHOE AND ASSOCIATED METHOD

CROSS REFERENCE TO RELATED APPLICATIONS

This application claims the benefit of U.S. Provisional Application No. 61/225,962, filed Jul. 16, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION TECHNICAL FIELD

This invention relates to footwear and, more particularly, to an adjustably vented shoe for providing users with a means of regulating an air flow to maintain cool and dry feet throughout the day.

PRIOR ART

When we think about the tools that we use to make our livings, we tend to think about things like hammers and saws, laptop computers or pipe-wrenches, stethoscopes or jack-hammers. Tools are crucial to civilization, and each of us uses tools to do our work. But as different as our jobs, and therefore our tools might be, all working people have a few things in common. We all work better after a good night's sleep. We all need food to fuel our brains and bodies, and exercise to keep us strong. We all prefer a work environment where we are respected and valued, and where the skills we bring to our work are equal to the challenges we face.

And, for many of us, work means being on our feet for hours at a time, and coming home at the end of the day with tired, aching feet. Aching feet are a consequence of what anthropologists refer to as "bipedal locomotion": walking on two feet, being human. And while work shoes, and shoes in general, have come a long way in the last fifty years, there's still no steel-toed boot as comfortable as a sneaker, and still no work shoe as cool as a sandal. Consider the plight of a roofer who works on rooftops with hot tar and asphalt, and who must wear protective boots for this work—would this man appreciate a pair of safety boots that also kept his feet cool and dry? Added to this, the wet and damp interior of shoes give rise to fungal infections and feet odor which can be detrimental to the well being of a person subjected to work in a hot and humid environment.

Accordingly, a need remains for an apparatus in order to overcome the above-noted shortcomings. The present invention satisfies such a need by providing an adjustably vented shoe that is convenient and easy to use, is durable yet lightweight in design, is versatile in its applications, and provides a user with a means of regulating an air flow rate to maintain cool and dry feet throughout the day.

BRIEF SUMMARY OF THE INVENTION

In view of the foregoing background, it is therefore an object of the present invention to provide an adjustably vented shoe for permitting air flow to ingress and egress an interior of the shoe and thereby maintain cool and dry feet during extended use. These and other objects, features, and advantages of the invention are provided by an adjustably vented shoe including a body adapted to cover an entire user foot therein. Such a body preferably has an outer surface provided with an opening formed therethrough. The shoe further includes a first plate statically interfitted within the opening, a mesh screen statically interfitted within the opening and abutted with the first plate respectively, and a second plate adjustably engaged with the first plate respectively. Notably, the first plate and the mesh screen remain stationary while the second plate is dynamically displaced between open and closed positions relative to the first plate and the mesh screen respectively. In this manner, the mesh screen is exposed to ambient air when the second plate is displaced to the open position such that air is permitted to freely ingress and egress the shoe via the mesh screen.

In one embodiment, the mesh screen is coplanar with the first plate in such a manner that the mesh screen and first plate collectively extend along an entire surface area of the opening. The second plate may be spaced exterior of the mesh screen and thereby covers an entire surface area of the mesh screen when the second plate is disposed at the closed position.

In one embodiment, the first plate may include first, second and third sides attached to a continuously extending inner wall of the opening respectively. A fourth side may be spaced from the inner wall. In this manner, the first and second parallel sides of the mesh screen are directly connected to a first section of the inner wall and a medial side of the first plate respectively. Notably, the first section of the inner wall may be oriented parallel the medial side of the first plate.

In one embodiment, the shoe may further include a deodorant patch registered parallel to the mesh screen and statically connected to the first plate and the inner wall of the opening. Such a deodorant patch may be disposed anterior of the mesh screen and posterior of the second plate such that the deodorant patch is isolated from the ambient air when the second plate is displaced to the closed position.

In one embodiment, the second plate may be slidably reciprocated along a linear path defined within the opening. The second plate preferably has a posterior face slidably abutted against an anterior face of the first plate while the second plate is displaced between the open and closed positions. In this manner, the second plate remains aligned parallel to the first plate while the second plate is displaced between the open and closed positions.

In one embodiment, the second plate may be pivotally coupled to the first plate and selectively reciprocated along a curvilinear path extending outwardly and away from the opening. In this configuration, the second plate preferably has an anterior face selectively engaged against an anterior face of the first plate while the second plate is selectively displaced between the open and closed positions. Thus, the anterior face of the second plate may be coplanar with the anterior face of the first plate when the second plate is pivoted to the open position.

In one embodiment, the second plate is capable of being selectively reciprocated about clockwise and counter clockwise directions between the open and closed positions respectively.

The present invention may further include a method of utilizing an adjustably vented shoe for permitting air flow to ingress and egress an interior of the shoe and thereby maintain cool and dry feet during extended use. Such a method preferably includes the chronological steps of: providing a body;

covering an entire user foot with the body wherein the body preferably has an outer surface provided with an opening formed therethrough; providing and statically interfitting a first plate within the opening; providing and statically interfitting a mesh screen within the opening; abutting the mesh screen with the first plate; providing and adjustably engaging a second plate with the first plate; maintaining the first plate and the mesh screen at a stationary position; dynamically displacing the second plate between open and closed positions relative to the first plate and the mesh screen respectively; and exposing the mesh screen to ambient air by displacing the second plate to the open position and thereby permitting air to freely ingress and egress the shoe via the mesh screen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
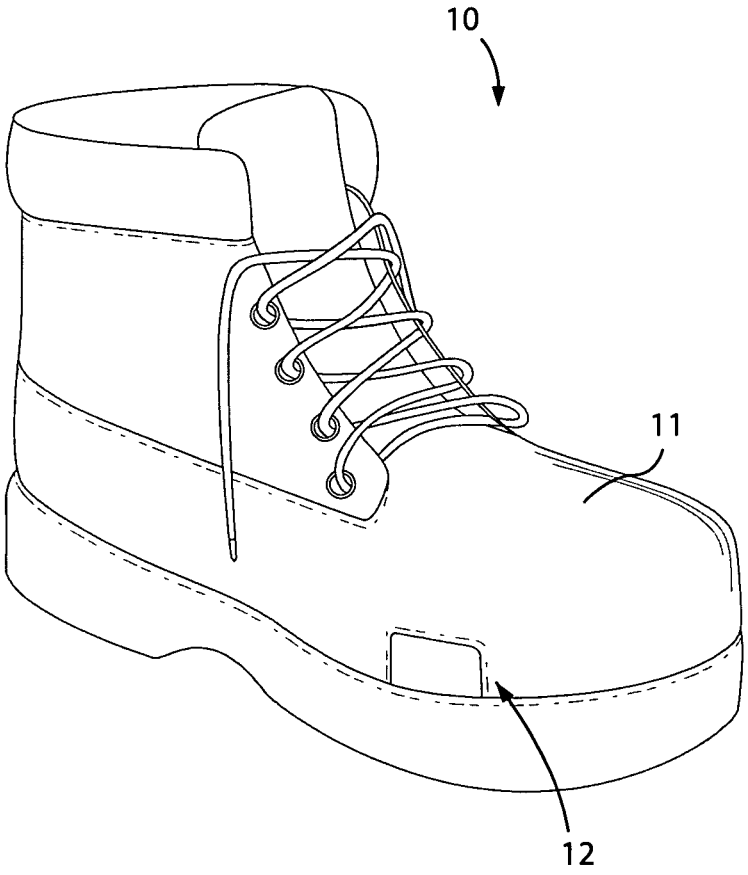
FIGS. 1-3 are perspective views showing various locations of the opening along the shoe body, in accordance with the present invention.
Figure 2:
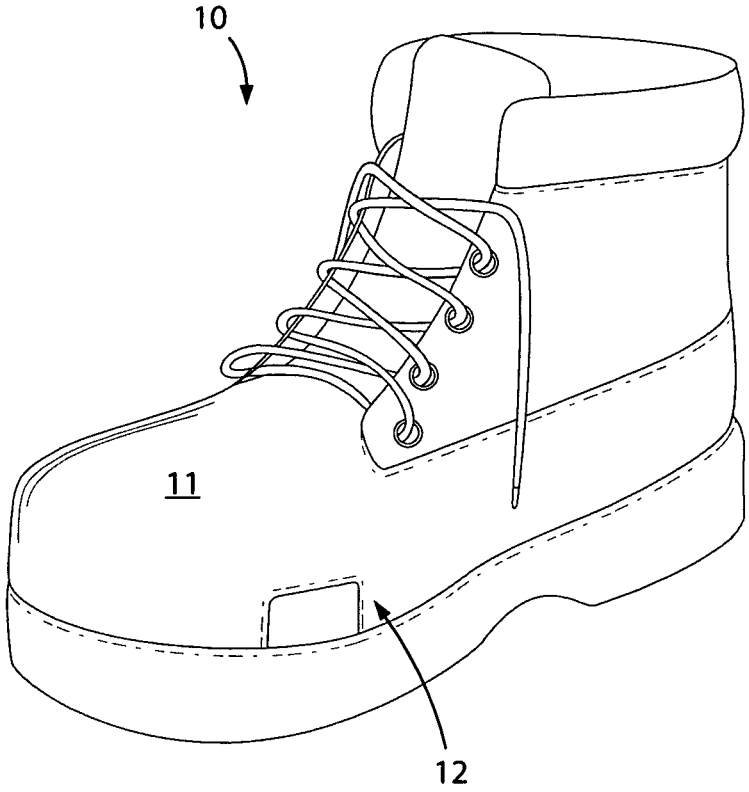
Figure 3:
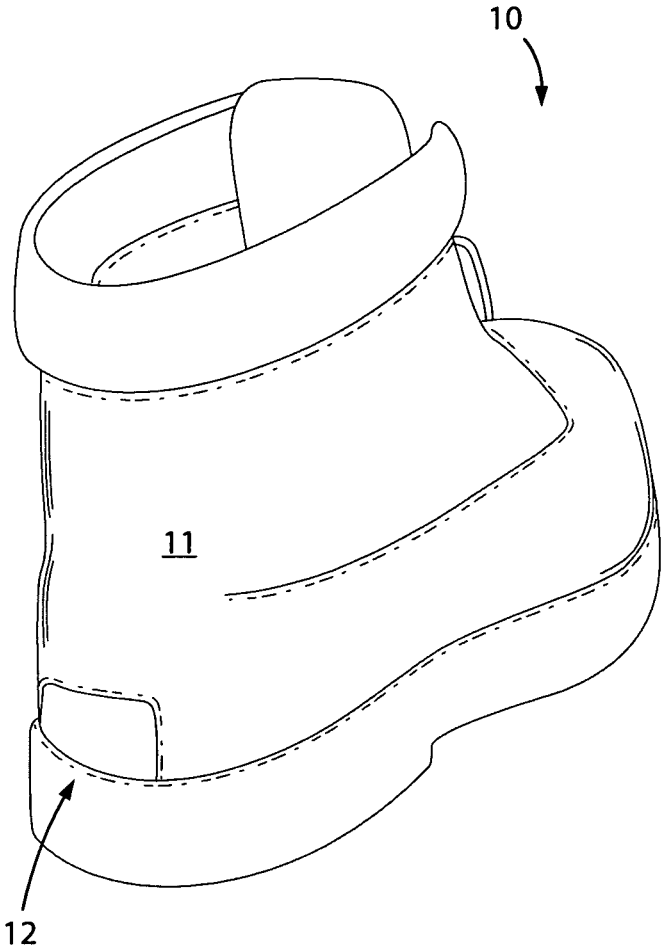

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The apparatus of this invention is referred to generally in FIGS. 1-11 by the reference numeral 10 and is intended to provide an adjustably vented shoe 10 for permitting air flow to ingress and egress an interior of the shoe 10 and thereby maintain cool and dry feet during extended use. It should be understood that the adjustably vented shoe 10 may be used in a variety of environments and should not be limited to any particular indoor or outdoor activity.

Referring to FIGS. 1-11, an adjustably vented shoe 10 includes a body 11 adapted to cover an entire user foot therein. Such a body 11 preferably has an outer surface provided with an opening 12 formed therethrough. As noted in FIGS. 1-3, the opening 11 may be located at various area of the body 10. Also, multiple openings 12 may be provided in the body 10.

As perhaps best shown in FIGS. 4-11, shoe 10 further includes a first plate 13 statically interfitted within the opening 12, a mesh screen 15 statically interfitted within the opening 12 and abutted with the first plate 13 respectively, and a second plate 14 adjustably engaged with the first plate 13 respectively. Notably, the first plate 13 and the mesh screen 15 remain stationary while the second plate 14 is dynamically displaced between open and closed positions relative to the first plate 13 and the mesh screen 15 respectively. One skilled in the art understands a conventional tongue/groove configuration or guide track may be positioned along sections 20*c*, 20*d* of inner wall 20 of opening 12. Other conventional mechanism may be employed to permit linear displacement of second plate 14, well-known in the industry, without departing from the true spirit and scope of the present invention.

Figure 4:
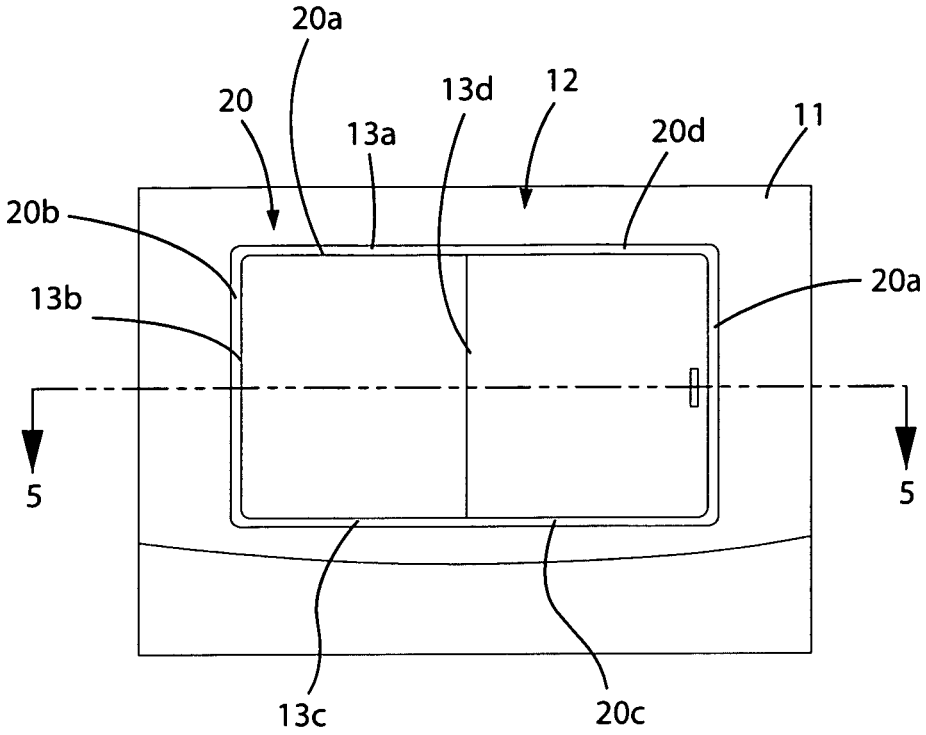
FIG. 4 is an enlarged front elevational view showing the first and second plates positioned in an exemplary opening wherein the second plate is displaced to the closed position.
Figure 5:
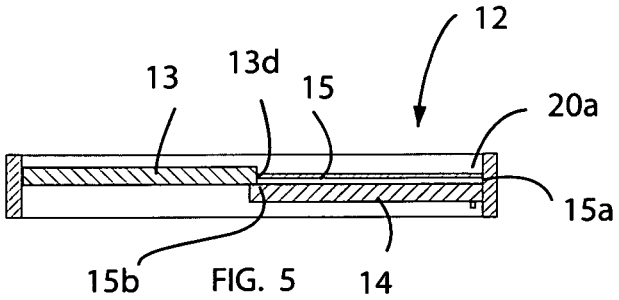
FIG. 5 is a cross-sectional view of the first and second plates, taken along line 5-5 in FIG. 4.
Figure 6:
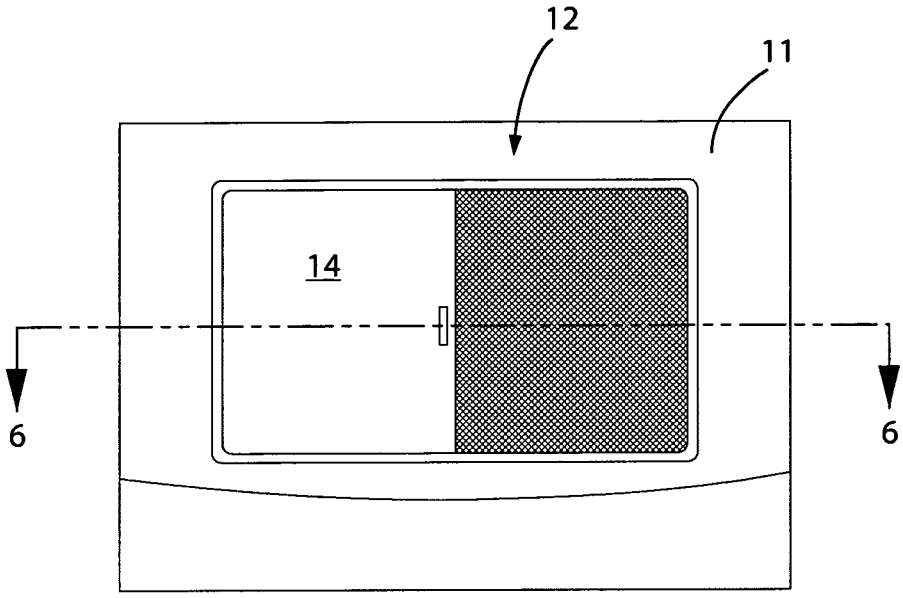
FIG. 6 is an enlarged front elevational view showing the first and second plates positioned in an exemplary opening wherein the second plate is linearly displaced to the open position.
Figure 7:
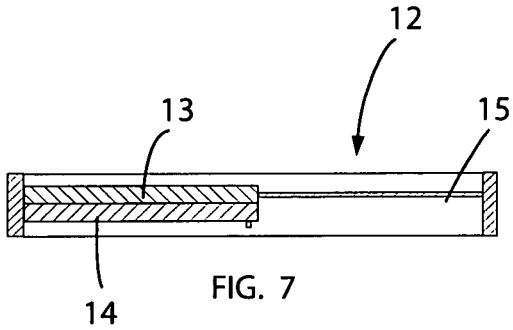
FIG. 7 is a cross-sectional view of the first and second plates, taken along line 7-7 in FIG. 6, thereby showing the mesh screen exposed to ambient air.

FIGS. 4 and 5 show second plate 14 at the closed position. FIGS. 6-9 and 11 shown second plate 14 at the open position. In this manner, the mesh screen 15 is exposed to ambient air when the second plate 14 is displaced to the open position such that air is permitted to freely ingress and egress (circulate) throughout the shoe 10 via the mesh screen 15. The advantage of such a structural configuration permits the user to selectively move the second plate 14 between the open and closed positions, as desired. Further, by maintaining the first plate 13 and mesh screen 15 at a consistently stationary position, the second plate 14 is unobstructed and freely reciprocates or pivots during extended activities.

In one embodiment, as perhaps best shown in FIGS. 4-9, the mesh screen 15 is coplanar with the first plate 13 in such a manner that the mesh screen 15 and first plate 13 collectively extend along an entire surface area of the opening 12. The second plate 14 may be spaced exterior of the mesh screen 15 and thereby covers an entire surface area of the mesh screen 15 when the second plate 14 is disposed at the closed position. Such a structural configuration provides the advantage of ensuring the mesh screen 15 remains unencumbered when the second plate 14 is displaced to the open position. For example, second plate 14 is prohibited from becoming stuck in the opening while at the closed position. Also, second plate 14 is thereby free to reciprocate along the width of opening 12 without being urged through opening 12 during an accidental impact because first plate 13 and mesh screen 15 shield opening 12 and prevent second plate 14 from being undesirably pushed into the interior of the shoe 10.

In one embodiment, the first plate 13 may include first 13*a*, second 13*b* and third 13*c* sides attached to the continuously extending inner wall 20 of the opening 12 respectively. A fourth side 13*d* may be spaced from the inner wall 20. In this manner, the first 15*a* and second 15*b* parallel sides of the mesh screen 15 are directly connected to a first section 20*a* of the inner wall 20 and a medial side 13*d* of the first plate 13, respectively. Notably, the first section 20*a* of the inner wall 20 may be oriented parallel the medial side 13*d* of the first plate 13. The advantage of such a structural configuration ensures that mesh screen 15 is maintains a continuous frictional forces along sides 15*a*, 15*b* thereof. Mesh screen 15 thereby remains registered along a planar configuration spaced posterior to second plate 14 and is prevented from interfering with second plate 14 linear displacement, as perhaps best shown in FIGS. 8-9.

In one embodiment, the shoe 10 may further include a deodorant patch 16 registered parallel to the mesh screen 15 and statically connected to the first plate 13 and the inner wall 20 of the opening 12. Such a deodorant patch 16 may be disposed anterior of the mesh screen 15 and posterior of the second plate 14 such that the deodorant patch 16 is isolated from the ambient air when the second plate 14 is displaced to the closed position. By positioning deodorant patch 16 anterior of mesh screen 15, patch 16 becomes intercalated between mesh screen 15 and second plate 14. Such a sandwiched location shelters patch 16 from prematurely losing its scent as well as from foreign liquids that can soak/dilute the aroma concentration of patch 12.

Figure 8:
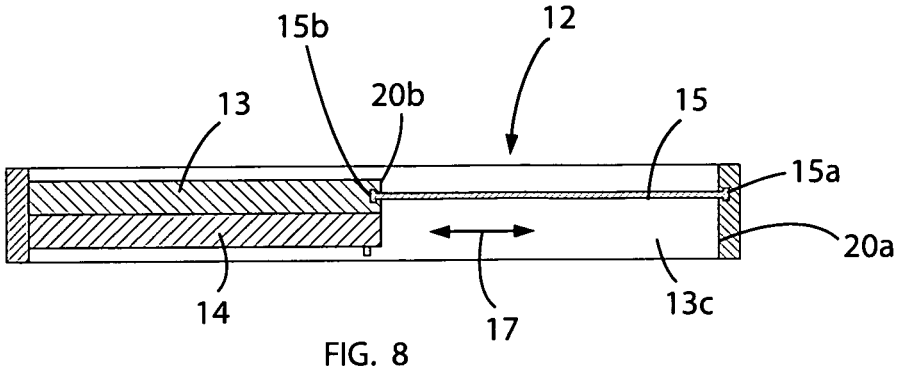
FIG. 8 is an enlarged view of FIG. 7 showing the structural relationship between the inner wall of the opening and the first plate with the second plate linearly displaced to the open position.
Figure 9:
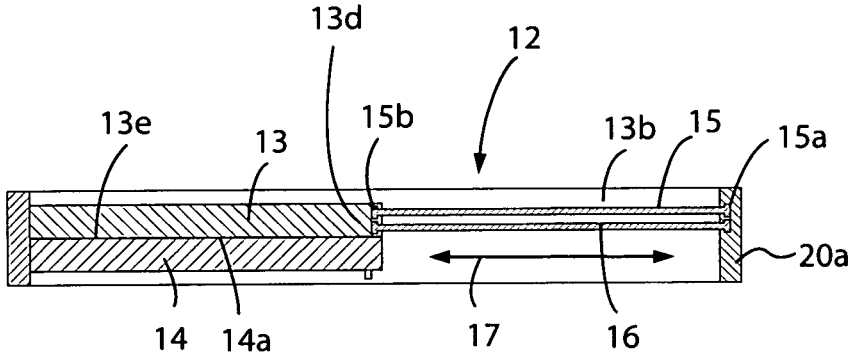
FIG. 9 is an enlarged cross-sectional view showing the deodorant patch positioned in the opening with the second plate linearly displaced to the open position, in accordance with one embodiment of the present invention.

As perhaps best shown in FIGS. 8-9, the second plate 14 may be slidably reciprocated along a linear path 17 defined within the opening 12. The second plate 14 preferably has a posterior face 14*a* slidably abutted against an anterior face 13*e* of the first plate 13 while the second plate 14 is displaced between the open and closed positions. The advantage of such a structural configuration ensures the second plate 14 remains aligned parallel to the first plate 13 while the second plate 14 is displaced between the open and closed positions.

Figure 10:
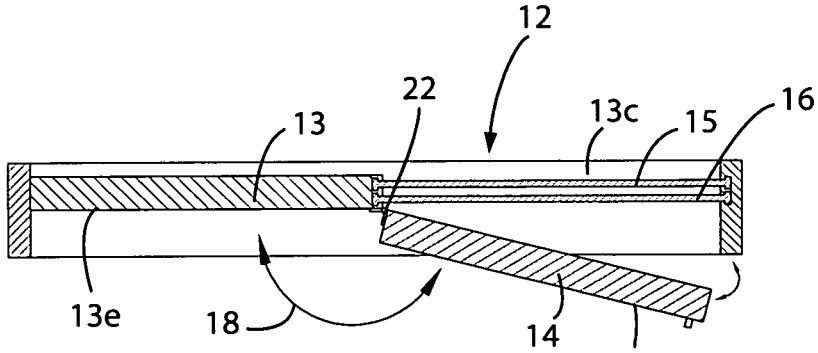
FIG. 10 is an enlarged cross-sectional view showing an alternate embodiment of the present invention wherein the second plate pivots relative to the first plate.

As perhaps best shown in FIG. 10, in one embodiment, the second plate 14 may be pivotally coupled to the first plate 13 and selectively reciprocated along a curvilinear path 18 extending outwardly and away from the opening 12. In this configuration, the second plate 14 preferably has an anterior face 14*b* selectively engaged against the anterior face 13*e* of the first plate 13 while the second plate 14 is selectively displaced between the open and closed positions. Thus, the anterior face 14*b* of the second plate 14 may be coplanar with the anterior face 13*e* of the first plate 13 when the second plate 14 is pivoted to the open position.

Figure 11:
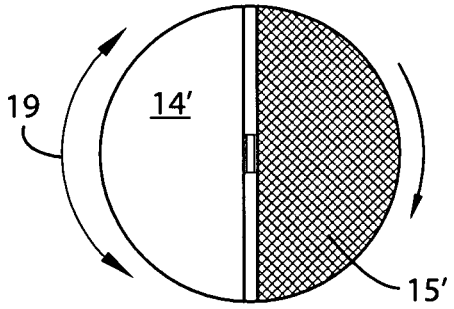
FIG. 11 is a front elevational view showing an alternate embodiment of the present invention wherein the second plate is rotatably coupled to the first plate and capable of being articulated between clockwise and counter clockwise directions.

In one embodiment, the second plate 14' is capable of being selectively reciprocated about clockwise and counter clockwise directions 19 between the open and closed positions respectively, as perhaps best shown in FIG. 11. Mesh screen 15' remains stationary during such rotational movement.

The present invention may further include a method of utilizing an adjustably vented shoe 10 for permitting air flow to ingress and egress (circulate) through an interior of the shoe 10 and thereby maintain cool and dry feet during extended use. Such a method preferably includes the chronological steps of: providing a body 11; covering an entire user foot with the body 11 wherein the body 11 preferably has an outer surface provided with an opening 12 formed therethrough; providing and statically interfitting a first plate 13 within the opening 12; providing and statically interfitting a mesh screen 15 within the opening 12; abutting the mesh screen 15 with the first plate 13; providing and adjustably engaging a second plate 14 with the first plate 13; maintaining the first plate 13 and the mesh screen 15 at a stationary position; dynamically displacing the second plate 14 between open and closed positions relative to the first plate 13 and the mesh screen 15 respectively; and exposing the mesh screen 15 to ambient air by displacing the second plate 14 to the open position and thereby permitting air to freely ingress and egress (circulate) the shoe 10 via the mesh screen 15.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. An adjustably vented shoe for permitting air flow to ingress and egress an interior of the shoe and thereby maintain cool and dry feet during extended use, said adjustably vented shoe comprising:

a body adapted to cover an entire user foot therein, said body having an outer surface provided with an opening formed therethrough;

a first plate interfitted within said opening;

a mesh screen interfitted within said opening and abutted with said first plate respectively; and a second plate engaged with said first plate respectively;

wherein said first plate and said mesh screen remain stationary while said second plate is displaced between open and closed positions relative to said first plate and said mesh screen respectively;

wherein said mesh screen is exposed to ambient air when said second plate is displaced to said open position such that air is permitted to freely ingress and egress the shoe via said mesh screen;

wherein said mesh screen is coplanar with said first plate and collectively extend along an entire surface area of said opening, said second plate being spaced exterior of said mesh screen and covering an entire surface area of said mesh screen when disposed at said closed position;

wherein said first plate comprises first, second and third sides attached to a continuously extending inner wall of said opening respectively; and a fourth side spaced from said inner wall;

wherein first and second parallel sides of said mesh screen are directly connected to a first section of said inner wall and a medial side of said first plate respectively, said first section of said inner wall being oriented parallel said medial side of said first plate.

2. The adjustably vented shoe of claim 1, further comprising:

a deodorant patch registered parallel to said mesh screen and statically connected to said first plate and said inner wall of said opening, said deodorant patch being disposed anterior of said mesh screen and posterior of said second plate such that said deodorant patch is isolated from the ambient air when said second plate is displaced to said closed position.

3. The adjustably vented shoe of claim 2, wherein said second plate is slidably reciprocated along a linear path defined within said opening, said second plate having a posterior face slidably abutted against an anterior face of said first plate while said second plate is displaced between said open and closed positions, said second plate remaining aligned parallel to said first plate while said second plate is displaced between said open and closed positions.

4. The adjustably vented shoe of claim 2, wherein said second plate is pivotally coupled to said first plate and selectively reciprocated along a curvilinear path extending outwardly and away from said opening, said second plate having an anterior face selectively engaged against an anterior face of said first plate while said second plate is selectively displaced between said open and closed positions, said anterior face of said second plate being coplanar with said anterior face of said first plate when said second plate is pivoted to said open position.

5. The adjustably vented shoe of claim 1, wherein said second plate is capable of being selectively reciprocated about clockwise and counter clockwise directions between said open and closed positions respectively.

6. An adjustably vented shoe for permitting air flow to ingress and egress an interior of the shoe and thereby maintain cool and dry feet during extended use, said adjustably vented shoe comprising:

a body adapted to cover an entire user foot therein, said body having an outer surface provided with an opening formed therethrough;

a first plate statically interfitted within said opening;

a mesh screen statically interfitted within said opening and abutted with said first plate respectively; and a second plate adjustably engaged with said first plate respectively;

wherein said first plate and said mesh screen remain stationary while said second plate is dynamically displaced between open and closed positions relative to said first plate and said mesh screen respectively;

wherein said mesh screen is exposed to ambient air when said second plate is displaced to said open position such that air is permitted to freely ingress and egress the shoe via said mesh screen;

wherein said mesh screen is coplanar with said first plate and collectively extend along an entire surface area of said opening, said second plate being spaced exterior of said mesh screen and covering an entire surface area of said mesh screen when disposed at said closed position;

wherein said first plate comprises first, second and third sides attached to a continuously extending inner wall of said opening respectively; and a fourth side spaced from said inner wall;

wherein first and second parallel sides of said mesh screen are directly connected to a first section of said inner wall and a medial side of said first plate respectively, said first section of said inner wall being oriented parallel said medial side of said first plate.

7. The adjustably vented shoe of claim 6, further comprising:

a deodorant patch registered parallel to said mesh screen and statically connected to said first plate and said inner wall of said opening, said deodorant patch being disposed anterior of said mesh screen and posterior of said second plate such that said deodorant patch is isolated from the ambient air when said second plate is displaced to said closed position.

8. The adjustably vented shoe of claim 7, wherein said second plate is slidably reciprocated along a linear path defined within said opening, said second plate having a posterior face slidably abutted against an anterior face of said first plate while said second plate is displaced between said open and closed positions, said second plate remaining aligned parallel to said first plate while said second plate is displaced between said open and closed positions.

9. The adjustably vented shoe of claim 7, wherein said second plate is pivotally coupled to said first plate and selectively reciprocated along a curvilinear path extending outwardly and away from said opening, said second plate having an anterior face selectively engaged against an anterior face of said first plate while said second plate is selectively displaced between said open and closed positions, said anterior face of said second plate being coplanar with said anterior face of said first plate when said second plate is pivoted to said open position.

10. The adjustably vented shoe of claim 6, wherein said second plate is capable of being selectively reciprocated about clockwise and counter clockwise directions between said open and closed positions respectively.

* * * * *